United States Patent [19]

Allen

[11] 3,962,943

[45] June 15, 1976

[54] SAFETY APPARATUS FOR A CABLE FEED SYSTEM

[76] Inventor: Burl A. Allen, 419 Garrett, Lindsay, Okla. 73052

[22] Filed: Aug. 14, 1974

[21] Appl. No.: 497,312

[52] U.S. Cl. ..... 83/370; 83/373; 83/360; 83/399; 242/48; 242/56.6; 242/75.43

[51] Int. Cl.[2] ..... B26D 5/38

[58] Field of Search ..... 83/370, 373, 372, 360, 83/399; 242/48, 56.6, 75.43

[56] References Cited

UNITED STATES PATENTS

| | | | |
|---|---|---|---|
| 631,783 | 8/1899 | Foster | 83/370 |
| 1,018,274 | 2/1912 | Sheehan et al. | 83/370 |
| 1,942,069 | 1/1934 | Setoguchi et al. | 83/370 |
| 2,959,998 | 11/1960 | Etzenhouser | 83/373 |

*Primary Examiner*—Donald R. Schran
*Attorney, Agent, or Firm*—Dunlap, Codding & McCarthy

[57] ABSTRACT

A cable safety apparatus for use in a cable feeding system, comprising a pulley rotatably mounted on a frame, the pulley supporting the cable in a manner to provide a back pressure thereon. A locking member is slidably connected to the frame with a spring interposed therebetween, and the apparatus is suspended to a non-moving support structure by attaching the support end of the locking member to an external structure. The locking member and spring form a spring assembly that has locking engagement with a pivotable cutter blade that is biased to be in cutting engagement with the cable when the spring assembly is moved into clearing relationship with the cutter blade.

4 Claims, 5 Drawing Figures

SAFETY APPARATUS FOR A CABLE FEED SYSTEM

BACKGROUND OF THE INVENTION

1. Field of Invention

The present invention relates generally to the field of cable feed apparatus, and more particularly, but not by way of limitation, to a safety apparatus for severing cable.

2. Description of the Prior Art

In the petroleum industry, it is often necessary to position electrically responsive equipment down the bore of an oil well or the like, an example of which is electric submersible pump or the like which are lowered beneath the surface of the earth secured to a tubing string for pumping liquid from the well. In order to supply electrical energy to down-hole electrical equipment, power cables run from an electrical power source located above-ground to the down-hole device. This necessitates the utilization of very long electrical cables, and cable feeding systems have been devised to feed such cables upon demand to the down-hole equipment as it is lowered into the well bore.

The down-hole electrical equipment under consideration is usually supported from above ground by a plurality of pipe sections threadingly interconnected to form a well string. It is conventional practice to attach the electrical cable leading to the down-hole electrical equipment to the side of the supporting well string, and to position a rotatable spool wound with electrical cable in close proximity to the bore head so as to feed the electrical cable as required to follow the down-hole electrical equipment. Also, the spool is used to take up the cable when the down-hole electrical equipment is removed from the well bore.

In the cable feed system described, a problem of great magnitude is encountered when the supporting well string breaks. In consequence thereof, the electrical cable spool is suddenly attached to a free-falling portion of the well string, and an extremely hazardous condition occurs. The great weight and kinetic energy of the falling portion of the well string pulls with great force upon the cable spool, yanking the spool in a perilous manner free from its supports, and hurtles the spool toward the bore head. Property damage by this catastrophic occurrence is always forthcoming, and even more unfortunate, persons have been fatally injured as the spool is practically unstoppable in its path of wreckage.

SUMMARY OF INVENTION

The present invention provides a cable safety apparatus comprising tension means for providing a back pressure on the cable, and tension sensing means for determining when the cble tension reaches a predetermined value, indicative of a break in the supporting well string. At the time that the cable tension is determined to reach the predetermined level, cutting means responsive to the tension sensing means severs the electrical cable, thereby freeing the falling portion of the cable.

It is therefore an object of the present invention to provide a safety apparatus for use with a cable feed system wherein a sudden surge in cable tension is detected and prevented from being exerted upon the cable feeding system.

Another object of the present invention is to provide a safety apparatus for use with a cable feed system that achieves the above object while imposing minimum resistance to the cable feed system.

Another object of the present invention is to provide a safety apparatus for use with a cable feed system that can be used with a wide variety of cable sizes, types and spools.

Another object of the present invention is to provide a safety apparatus for use with a cable feed system that offers simplicity of construction and design, and requires a minimum in manufacturing costs and upkeep.

Other objects, features and advantages of the present invention will become clear from the following detailed description of the preferred embodiment when taken in conjunction with the accompanying figures.

DESCRIPTION OF THE PREFERRED EMBODIMENT

Figure 1:
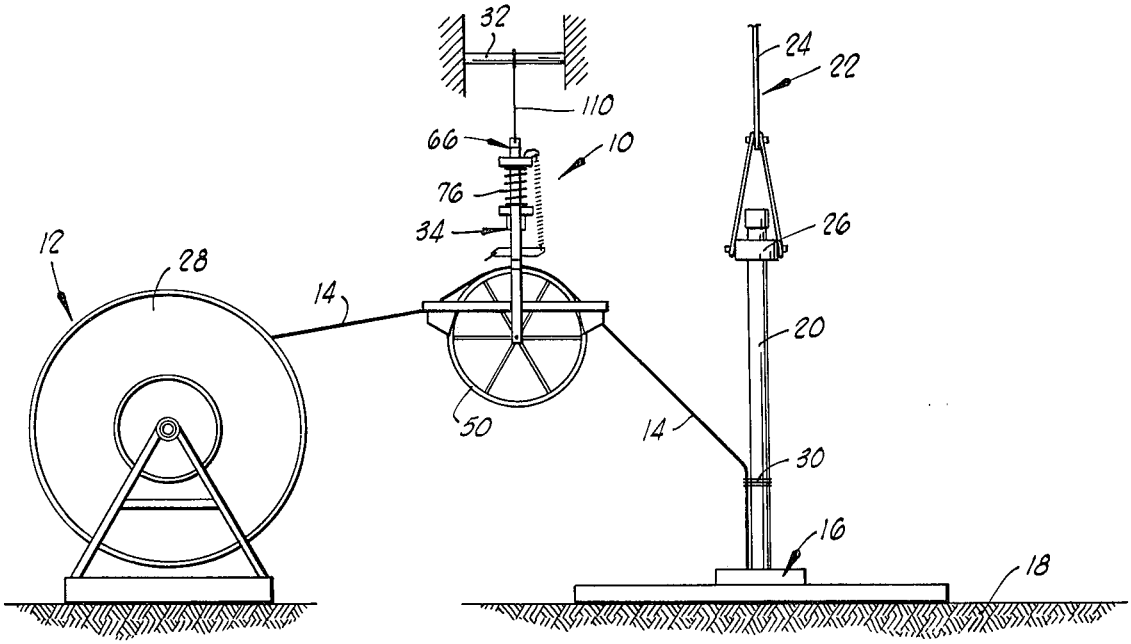
FIG. 1 is a semi-diagrammatical representation of the cable safety apparatus of the present invention in use with a cable feeding system.

Referring to the figures in general and particularly to FIG. 1, designated therein by the numeral 10 is the cable safety apparatus of the present invention as used in a cable feed system 12 which is feeding an electrical cable 14 into a well bore 16. It will be understood that the well bore 16 represents an oil well or the like in which a bore passes into the ground 18 to usually very great depths. The well string 20 is supported by rig equipment 22 that comprises a stationary derrick or the like from which a steel cable 24 and a gripping device 26 are used in conjunction with power hoist equipment (not shown) to lower or raise the well string 20 from the wellbore 16. Conventional oil well equipment is utilized to grasp and retain the well string 20 at the well bore 16 while the rig equipment 22 is removed therefrom in order to grasp and position another length of pipe to threadingly join with the wall string 20, thereby lengthening the well string in increments of pipe sections as the well string 20 is lowered to the desired depth.

As the well string 20 is lowered in well bore 16, electrical cable 14 is fed from a spool 28 and passes in rolling contact with the safety apparatus 10, in a manner to be made clear below, on its way to connection with the well string by spaced apart connecting straps 30. In this manner, the electric cable 14 is protected from entanglement with the sides of the well bore 16, and it is returned from the well bore with the pulling of the well string 20. As well string 20 is pulled from well bore 16, the cable connectors 30 are removed and the reel 28 is caused to rewind cable 14.

FIG. 1 demonstrates a typical setup of the safety apparatus 10 of the present invention. As will be made clear below, the apparatus 10 is suspended from a stationary support structure 32, and this support structure may be selected as required for a particular application. Typically, the support structure 32 is a portion of the derrick or pulling unit that is operating on the well string 20.

It will be understood that some form of down-hole electrical equipment is supported on the well string 20 in FIG. 1, and that the distal end of cable 4 extends along the length of the well string to where it electrically connects to the down-hole equipment.

One of the objects of the present invention is to provide a safety apparatus in a cable feed system that offers a minimum of resistance to the cable as it is unreeled and fed to the down-hole electrical equipment. As will be discussed in more detail below, the cable 14 is caused to pass over a rotatable pulley from which the cable is fed to the well string 20 with a minimum of resistance, and only should a failure of the well string occur, will the apparatus 10 in any way interfere with the normal operation of the cable feed system 12.

Figure 2:
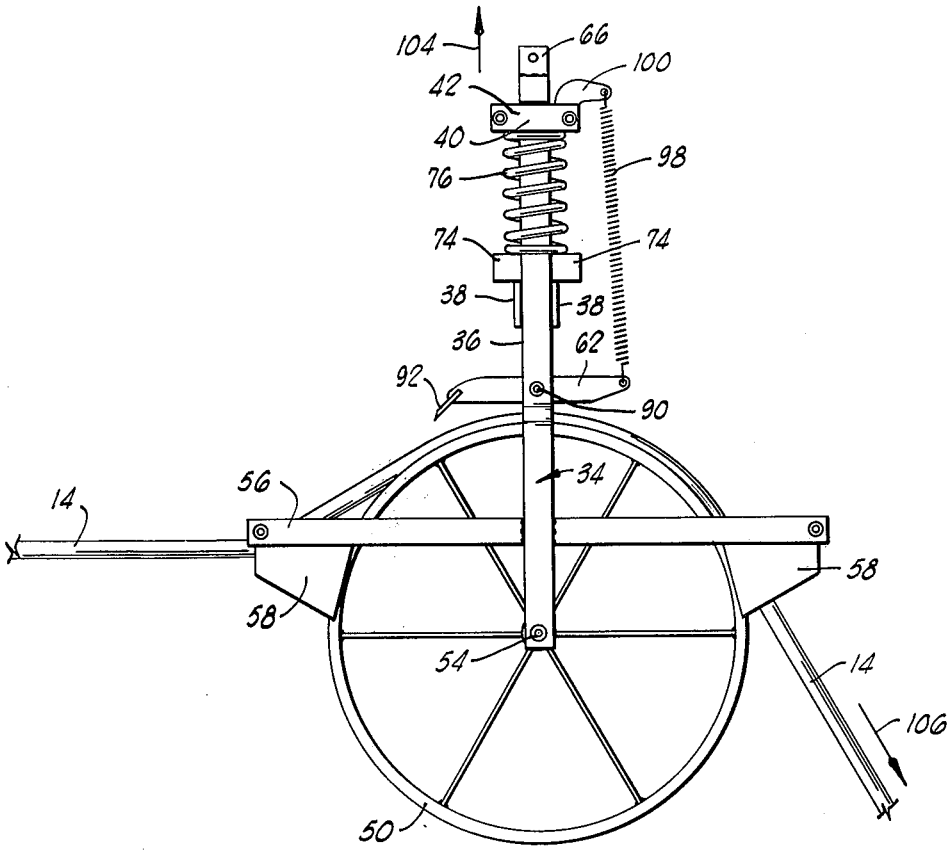
FIG. 2 is a side view of the cable safety apparatus of the present invention with the cutter blade member positioned in a non-cutting position.

FIG. 2 is a side view of safety apparatus 10. Shown therein is a frame 34 that is formed by a pair of parallel, elongated frame members 36 that are in side by side, spaced apart relationship established by a pair of transverse plates 38 welded thereto and best seen in FIG. 3, an end view of apparatus 10. Each of the frame members 36 has a cross member 40 at end 42. Apertures are appropriately placed in the cross members 40 and bolts 44 pass therethrough to securedly fasten and establish the distance between the ends 42 of the frame members 36. One method of adjustably establishing the distance between the ends 42 is by staking the bolt 44 at its bolt head 46 to one of the cross members 42, and providing a double nut arrangement as shown in FIG. 3 wherein the position of the other cross member 42 relative to the bolt may be adjusted within the resiliency range of the frame members 36.

Figure 3:
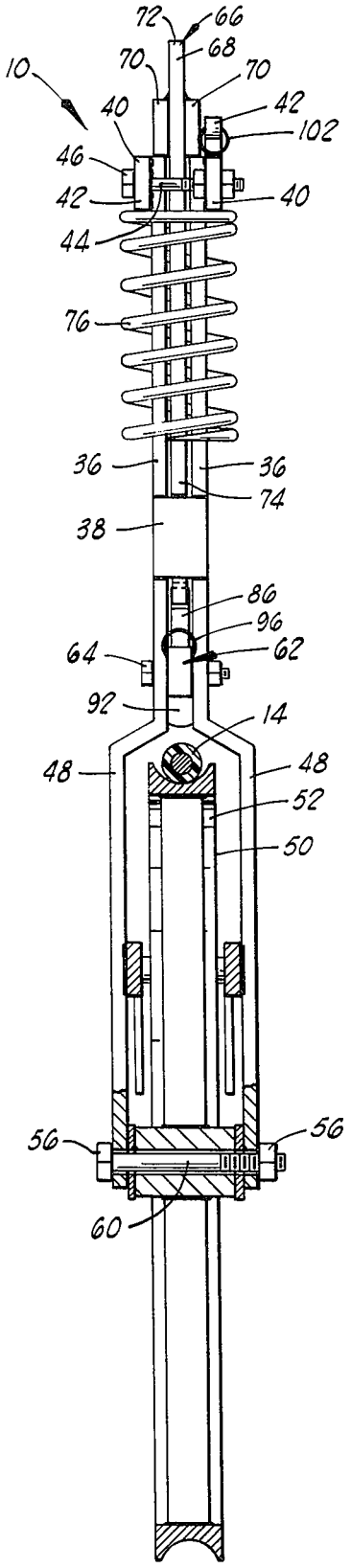
FIG. 3 is a partial cutaway end view of the cable safety apparatus of the present invention.

As shown in FIGS. 2 and 3, the frame members 36 each have a portion 48 formingly spread to a greater distance so as to receive a pulley 50 therebetween. The pulley 50 has a shaped sheave 52 which forms a track for the receiving of cable 14 passing in rolling contact therewith. The pulley 50 is mounted via conventional bearing and axle means supported between the ends 54 of the frame members 36 in a manner to have free rotating support thereby.

A pair of cross frame members 56 are welded transversely to the frame members 36. Shields 58 are supportingly attached to each end of the cross frame members 56 and are positioned clearingly thereat adjacent to the edges of the pulley 50 to serve as guides for the cable 14, thus assuring proper tracking of the cable 14 in a manner that causes the cable to pass directly under the cutter blade member to be described below. Pins 60 pass between and are staked to the ends of cross frame members 56 to establish the distance therebetween and to serve as limiting guides for the cable 14 as the cable is positioned thereagainst in the manner shown in FIG. 2.

Figure 4:
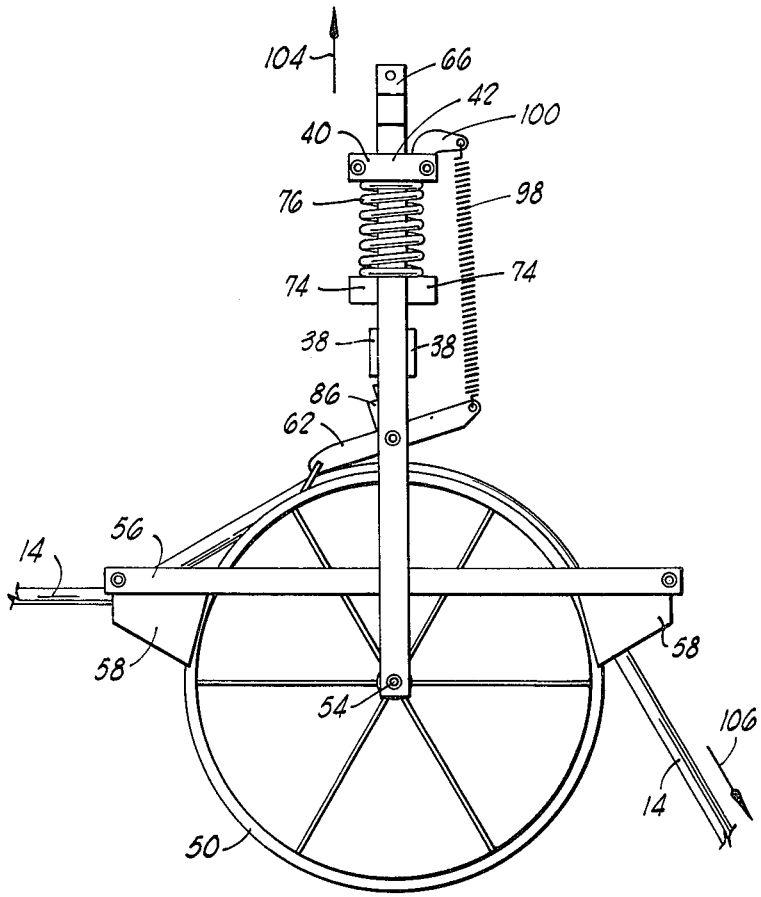
FIG. 4 is a side view of the cable safety apparatus of the present invention similar to FIG. 2 with the exception that the cutter blade is rotated to a cutting position relative to the cable.

A cutter blade member 62 is pivotally supported between the frame members 36. While the cutter blade member 62 will be described in more detail below, it is noted here that the bolt 64 passes through appropriately placed apertures in frame members 36 and through an aperture in the cutter blade 62 whereby the cutter blade is caused to be positionable in a non-cutting position as shown in FIG. 1, or the cutter blade may be rotated to a cutting position relative to the cable 14 as shown in FIG. 4.

Figure 5:
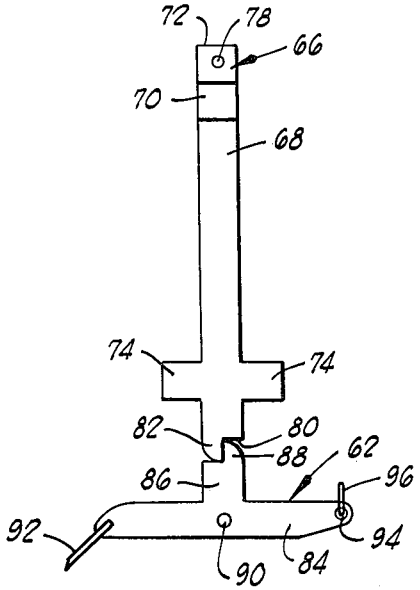
FIG. 5 shows the locking member and the cutter blade member of the present invention.

A locking member 66 is positioned between the frame members 36 above the cutter blade 62, as can be seen in FIGS. 2 and 3. The locking member 66 comprises an elongated member 68 to which is welded a pair of restraining members 70 near the top end 72 thereof. The elongated member 68 is slidingly passable between the frame members 36, but the restraining members 70 are of an appropriate dimension preventing their passage between the frame members. As shown in FIG. 5, the elongated member 68 is shaped to have a pair of extending ear members 74 extending from opposite sides thereof. The purpose of the extending ears 74 will be made clear by reference to the spring 76 as best shown in FIG. 2. The spring 76 is of the coil variety and is placed about the frame members 36 and caused to press against the underside of the cross members 40 at end 42 thereof, and against the extending ears 74 of locking member 66. The result of the placement of coil spring 76 in the manner described is that the locking member 66 is biased in a downward direction such that the restraining members 70 are stopped by the top of the frame members. In order to pull the locking member 66 and the frame 34 in opposite directions, the spring 76 must be compressed as it is squeezed between the extending ears 74 of locking member 66 and the cross members 40. As shown in FIG. 5, an aperture 78 is provided in the support end 72 of the elongated member 68, the purpose of which will be made clear below.

FIG. 5 shows the locking member 66 together with the cutter blade member 62 in their relative positions wherein these members are in locking engagement. At the lower end 80 of elongate member 68 there is found an extending locking tab 82 having a curved back edge. The lower end 80 is hereinbelow also referred to as the lock end 80. The cutter blade 62 comprises a blade holding member 84 that has an extending transverse member 86 that also has a locking tab 88 with a curved back edge. The blade holder 84 has an aperture 90 through which the bolt 64 pivotally supports the blade holder in the manner described above. The transverse member 86 is generally symmetrically extensive above the pivoting point 90 such that the locking tabs 82 and 88 are opposingly aligned as shown in FIG. 5. When these locking tabs are so placed, cutter blade member 62 is locked by the restraining action of locking tab 82 from pivoting about the pivot point 90 in a direction toward the cutting position thereof. As will become clear below, when the locking member 66 is pulled so as to compress the coil spring 76, the locking tab 82 is removed from locking engagement with the tab 88, and the cutter blade member 62 may be pivoted about pivot point 90. Further details of cutter blade 62 includes the angled knife 92 securedly attached to one end of blade holder 84, and an aperture 94 located at the other end thereof with an attaching loop 96 passing therethrough.

Connected to the loop 96 that is connected through the aperture 94 of cutter blade member 62 is a cutter blade biasing spring 98 shown in FIG. 2. The other end of the spring 98 is connected to a protruding spring support member 100 that is welded to a cross member 40 of one of the frame members 36. An aperture is placed at the distal end of the member 100 and a loop connector 102 is passed therethrough, the spring 98 connecting to this loop. It should be noted that the spring 98 is not shown in FIG. 3 in order not to interfere with the details of construction as described therefrom. The length and tension rating of spring 98 is selected to bias the cutter blade member 62 in the cutting position shown in FIG. 4, and permits the cutter blade member to be pivoted against the tension of spring 98 to the locked position as shown in FIG. 2. As was briefly discussed above, when the locking member 66 is pulled in the direction 104, and the frame 34 is restrained or caused to move in a direction opposite to direction 104, the locking tabs 82 and 88, of the locking member 66 and cutter blade member 62, respectively, are caused to separate, and the cutter blade is in clearing relationship to the locking member. The spring 98 then causes the pivoting of the cutter blade 62 about pivot point 90 so that the knife 92 is brought into cutting engagement with the cable 14 as shown in FIG. 4.

OPERATION OF THE PREFERRED EMBODIMENT

Referring once again to FIG. 1, the safety apparatus 10 of the present invention is shown supported to a stationary structure 32 by means of a steel cable 110 that is connected to the aperture 78 in the support end 72 of the locking member 66. Electrical cable 14 passes from the reel 28 over the pulley 50 and downwardly to be joined to the well string 20 as it is lowered. The pulley 50 offers only minor resistance to the pulling of the cable 14 from the reel 18, and in fact offers the advantage of more correctly positioning the cable 14 relative to the well string for attachment thereto by the cable connectors 30. Under normal operation, lowering of the well string 20 simply pulls the cable 14 over the pulley 50. For such normal operation, the cutter blade member 62 is in locking engagement with the locking member 66, a position wherein the spring assembly comprising the spring 76, locking member 66 and portions of the frame members 36 may be considered in a cocked position. That is, the locking member 66 has been compressed against the compressive force of coil spring 76 to permit the cutter blade member 62 to be reverse pivoted against the biasing influence of spring 98 such that the locking tabs 82 and 88 are brought into locking engagement as shown in FIG. 5. Releasing the locking member 66 then will cause the locking member to slide toward the cutter blade member 62 thereby positioning locking tab 82 in locking engagement with locking tab 88. The back edges of the locking tab 82 and 88, as discussed above, are curved so that the locking member 66 may be forced in an upward direction against the spring 76 by applying manual force to the cutter blade assembly at its end containing the aperture 94. However, the spring 76 often times is selected of such strength that external force must be applied to the spring 76 to enable the locking member 66 to move in the direction 104 relative to the frame.

When the cutter blade member 62 is in locking engagement with the locking member 66 as shown in FIG. 2, the safety apparatus 10 is in position for use with the cable feeding system 12 and applies a small back pressure (that is, a reverse force to the force pulling the cable 14 from the spool 28) to the cable 14. In the event of a well string failure, the cable 14 which is attached thereto will be suddenly jerked in a downward direction generally shown by the vector arrow 106 in FIG. 2. This downward force suddenly exerted upon cable 14 pulls with an increased downward force on the pulley 50 and consequently the frame 34 against the restraining force of cable 110 that is holding the locking member 66 to the support structure 32. This moves the relative position of the cutter blade member 62 downward with the frame 34 separating the locking tabs 82 and 88. When the cutter blade member 62 has been pulled sufficiently downward, the locking tabs 82, 88 are clear of each other, and the cutter blade biasing spring 98 causes the cutter blade member to rotate into the position shown in FIG. 4 wherein the cutter blade is in a cutting position relative to the cable 14 that is passing over the pulley 50. The cable 14 is positioned directly under the cutter blade member 62, and the sheave 52 is dimensioned such that the knife 92 can be brought to bear through the cable and against the pulley 50.

In cutting operation, as the knife 92 is brought to bear against the cable 14, the great force exerted in the downward direction by the weight of the falling portion of well string 20 will pull the knife blade into cable 14, thereby providing a very quick and clean cut to the cable 14. Once this is completed, the severed cable is freed to follow the falling portion of well string 20. This action frees the spool 28 from the destructive surge in tension that would be transmitted to the spool by the cable 14 were the safety apparatus not in interdisposed relationship as described herein.

In practice, it is important to select the coil spring 76 to have sufficient compressive strength that the safety apparatus 10 is not triggered into cutting the electrical cable 14 when minor downward forces are encountered. While the principle of operation of apparatus 10 would be the same, one would not want to experience the severance of cable 14 as occasioned by an erroneous interpretation by the device of a momentary downward force exerted accidentally. Therefore, it is recommended that the compressive force of spring 76 be carefully considered, as the spring serves as means for exerting a variable back pressure in the direction 104 contra to the direction 106 in cable 14, thereby serving to regulate and to control the slack in cable 14 as the cable 14 is fed into the well bore 16 with the well string 20. In practical applications, an compressive force of approximately 750 pounds per inch for spring 76 has been used successfully, together with a length of approximately one inch for the tabs 82 and 88.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A safety apparatus for a cable feed system, comprising:

a frame;

a pulley rotatably supported at one end of the frame, the cable passable over the pulley;

a cutter blade pivotally supported by the frame and positionable in a cutting position and in a non-cutting position relative to the cable;

a spring assembly supported by the frame comprising:

a locking member movable relative to the frame having a lock end, the lock end being positionable in locking engagement with the cutter blade wherein the cutter blade is positioned in the non-cutting position; and a spring biasing the locking member in locking engagement with the cutter blade; and, cutter blade biasing means pivoting the cutter blade to the cutting position when the locking member is in non-locking engagement with the cutter blade.

2. A safety apparatus for a cable feed system, comprising:

a frame member;

cable support means connected to the frame member supporting a portion of the cable;

a cutter blade rotatingly mounted to the frame and pivotable to a cutting position and to a non-cutting position relative to the cable;

a locking member slidably connected to the frame positionable in locking engagement with the cutter blade when the cutter blade is in the non-cutting position and in clearing relationship with the cutter;

spring means forcing with a predetermined force against the locking member releasably positioning the locking member in locking engagement with the cutter blade; and, cutter blade biasing means pivoting the cutter blade to the cutting position when the locking member is in clearing relationship to the cutter blade.

3. A safety cable cutting apparatus supportable from a support structure, comprising:

a frame;

a pulley rotatably supported at one end of the frame, the cable passable over the pulley;

a cutter blade pivotally supported by the frame and positionable in a cutting position and in a non-cutting position relative to the cable;

a spring assembly supported by the frame comprising:

a locking member movable relative to the frame having a support end and a lock end, the lock end being positionable in locking engagement with the cutter blade to prevent rotation of the cutter blade from the non-cutting position;

cutter blade biasing means pivoting the cutter blade to the cutting position when the locking member is in non-locking engagement with the cutter blade; and, means attaching the support end of the locking member to the support structure.

4. In a cable feeding system, the improvement comprising:

means providing back pressure on the cable;

tension sensing means for determining when the cable tension reaches a predetermined value, the tension sensing means characterized as comprising:

pulley means rollingly supporting the cable;

means supporting the pulley means; and a spring assembly; and cutting means for cutting the cable when the cable tension reaches the predetermined value, the cutting means characterized as comprising a cutter blade biased in a cutting position relative to the cable and positionable by the spring assembly in a non-cutting position, the cutter blade being released by the spring assembly when the cable tension reaches the predetermined value.

* * * * *